US008292017B2

(12) United States Patent
Inoue et al.

(10) Patent No.: US 8,292,017 B2
(45) Date of Patent: Oct. 23, 2012

(54) MOTORCYCLE

(75) Inventors: Yusuke Inoue, Wako (JP); Satoshi Matsushima, Wako (JP); Tatsuya Sasaki, Wako (JP); Hiroshi Nakashima, Wako (JP); Yuji Hayashi, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 0 days.

(21) Appl. No.: 13/196,453

(22) Filed: Aug. 2, 2011

(65) Prior Publication Data

US 2012/0031698 A1 Feb. 9, 2012

(30) Foreign Application Priority Data

Aug. 5, 2010 (JP) ..... 2010-176745

(51) Int. Cl.
*B62D 61/02* (2006.01)
*B62K 11/00* (2006.01)

(52) U.S. Cl. ..... 180/219; 180/227

(58) Field of Classification Search ..... 180/219, 180/227

See application file for complete search history.

(56) References Cited

U.S. PATENT DOCUMENTS 5,653,303 A * 8/1997 Kawamoto ..... 180/219
7,841,437 B2 * 11/2010 Bagnoli ..... 180/227
8,177,015 B2 * 5/2012 Kakuta ..... 180/296

FOREIGN PATENT DOCUMENTS

JP 2007-056714 A 3/2007

* cited by examiner

*Primary Examiner* — Lesley D Morris
*Assistant Examiner* — Marc Scharich
(74) *Attorney, Agent, or Firm* — Westerman, Hattori, Daniels & Adrian, LLP

(57) ABSTRACT

A silencer for a motorcycle has a front cup which has a tapered tubular shape, a center sleeve which is connected to the front cup, and a tail cup which is connected to the center sleeve. Since the front cup has a tapered tubular shape, the front cup is arranged such that a front end of the front cup is positioned in the vicinity of a main frame. A distal end of the silencer can be shifted frontward in the longitudinal direction of a vehicle compared to a silencer of a prior art. As a result, a length of the silencer can be increased while avoiding interference between the silencer and legs of a rider and hence, silencing performance of the silencer can be enhanced. Since the distal end of the silencer can be shifted frontward in the longitudinal direction of the vehicle, the concentration of a mass can be acquired.

10 Claims, 16 Drawing Sheets

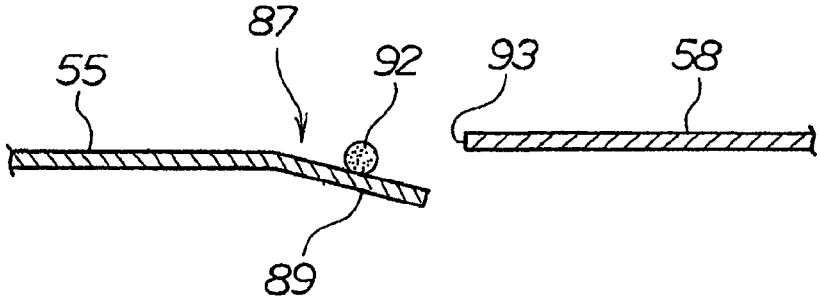
FIG. 13(a) COMPARISON EXAMPLE
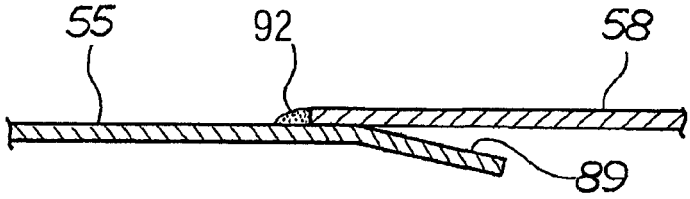
FIG. 13(b) COMPARISON EXAMPLE
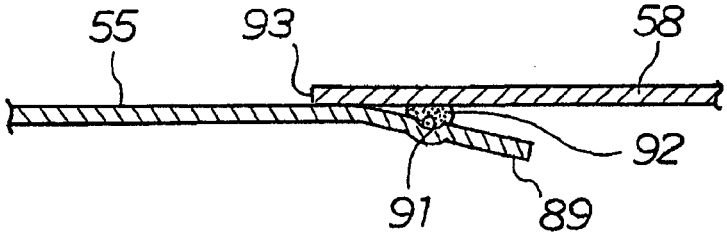
FIG. 13(c) EMBODIMENT

MOTORCYCLE

This application claims the benefit of priority of Japanese application JP2010-176745, the contents of which are incorporated by reference.

TECHNICAL FIELD

The present disclosure relates to a motorcycle, and more particularly to a motorcycle where a mounting position of a silencer is taken into consideration.

BACKGROUND

As one of measures to cope with noises, a silencer is mounted on an exhaust pipe of a motorcycle thus realizing the reduction of exhaust noises discharged from an internal combustion engine (for example, see Japanese Patent Application No. 2007-56714, FIG. 1 and FIG. 2).

FIG. 2 of patent document 1 shows the cross-sectional structure of a silencer (15) (numeral with a parenthesis indicating a symbol described in patent document 1, and same indication being applicable hereinafter). That is, the silencer (15) is configured such that a semispherical front cap portion (18) is mounted on a front end of an outer sleeve portion (17), a rear cap portion (19) is mounted on a rear end of the outer sleeve portion (17), and a sound absorbing material (20) is filled in the inside of the outer sleeve portion (17).

Acoustic energy of an exhaust gas which flows in an inner sleeve portion (16) is attenuated due to sudden expansion of the exhaust gas squeezed by sound absorbing holes (16c), and the sound absorbing material (20) absorbs sounds so that a silencing effect is acquired.

In the silencer (15) having such structure, by increasing a length of the outer sleeve portion (17) or by increasing an outer diameter of the outer sleeve portion (17), a volume of an expansion chamber can be increased and hence, silencing performance can be enhanced as a result.

As shown in FIG. 1 of patent document 1, the silencer (15) is arranged above a rear wheel (6). When the length of the outer sleeve portion (17) is increased aiming at the enhancement of silencing performance, the rear cap portion (19) projects rearward in the longitudinal direction of a vehicle from a rear fender (not indicated by a symbol).

When a length of the silencer (15) is increased so that the silencer (15) extends rearward in the longitudinal direction of the vehicle, a center of gravity of the silencer (15) is shifted toward a rear side of the vehicle thus influencing the concentration of a mass which a motorcycle is required to possess.

Amidst the demand for enhancement of performance of a silencer as one of measures to cope with an environmental problem, a silencer which does not influence the concentration of a mass even when a length of the silencer is increased is requested.

SUMMARY

It is an object of the present disclosure to provide, in a motorcycle, a silencer which does not influence the concentration of a mass even when a length of the silencer is increased.

Means for Solving the Problem

Part of the disclosure is directed to a motorcycle in which a pair of left and right main frames extends obliquely downward and rearward in the longitudinal direction of a vehicle from a head pipe, a swing arm is swingably connected to rear portions of the main frames, a rear wheel is rotatably mounted on the swing arm, an internal combustion engine is arranged below the main frames, an exhaust pipe extends frontward in the longitudinal direction of the vehicle from the internal combustion engine, turns backward, and extends rearward in the longitudinal direction of the vehicle through between the left and right main frames, and a silencer is connected to a rear end of the exhaust pipe, wherein the silencer includes: a front cup which, as viewed in a side view of the vehicle, has a front end thereof arranged in the vicinity of the main frames, has a tapered tubular shape where a cross-sectional area is increased rearward in the longitudinal direction of the vehicle, and has a rear end thereof arranged in front of a position of an axle when the swing arm is fully bent in the longitudinal direction of the vehicle, and accommodates a front pipe connected to the exhaust pipe therein; a center sleeve which extends rearward in the longitudinal direction of the vehicle from the rear end of the front cup and accommodates an inner pipe having a porous tubular shape connected to the front pipe therein; and a tail cup which extends rearward in the longitudinal direction of the vehicle from a rear end of the center sleeve and accommodates a tail pipe connected to the inner pipe therein.

A brake caliper which applies braking to the rear wheel can also be mounted on an upper surface of the swing arm, a recessed portion which is indented upward is formed on a lower surface of the center sleeve above a moving trajectory of the brake caliper due to swinging of the swing arm, and the brake caliper is accommodated in the recessed portion.

A seat pipe which supports a seat on which a rider sits extends rearward in the longitudinal direction of the vehicle from the main frames, and a lower pipe extends frontward and downward in the longitudinal direction of the vehicle to the main frames from a rear end of the seat pipe for preventing the deflection of the seat pipe, the front pipe is bent at a position between a front portion and a rear portion such that the rear portion of the front pipe becomes parallel to the lower pipe, and the rear portion extends to a middle portion of the front cup, and the inner pipe exhibits a linear shape parallel to the lower pipe, and extends to a middle portion of the front pipe.

A tail portion sound absorbing material can be filled in the tail cup such that the tail portion sound absorbing material surrounds the tail pipe, a center portion sound absorbing material is filled in the center sleeve connected to the tail cup such that the center portion sound absorbing material surrounds the inner pipe, a front portion sound absorbing material is filled in the front cup such that the front portion sound absorbing material surrounds the front pipe, and the front cup is connected to the center sleeve in such a state.

The front cup can be inserted into the center sleeve, an inserting portion of the front cup is constituted of a straight portion which is brought into contact with an inner peripheral surface of the center sleeve and a tapered portion which has a diameter thereof decreased in a tapered manner from a distal end of the straight portion, and an adhesive agent accumulation portion where an adhesive agent is accumulated is formed on at least one of the straight portion and the tapered portion.

The front cup can be formed by integrally welding left and right half bodies which are formed by press-molding a stainless steel sheet.

A first fastening portion which fastens the silencer to a vehicle body side can be formed on the front pipe at a position outside the front cup, a second fastening portion which fastens the silencer to the vehicle body side is formed on the center sleeve, and at least a half of a distance between the first fastening portion and the second fastening portion is occupied by the front cup, and a first vehicle-body-side fastening portion to which the first fastening portion is fastened is formed on a front end portion of the lower pipe, and a second vehicle-body-side fastening portion to which the second fastening portion is fastened is formed on a rear end portion of the lower pipe.

The center sleeve and the tail cup can be partitioned by a partition plate, and a support hole which supports a rear end of the inner pipe is formed in the partition plate, a plurality of communication holes which allow the inside of the center sleeve and the inside of the tail cup to communicate with each other are formed in the partition plate such that the communication holes surround the support hole, and a rib is formed in at least one of the communication holes by folding an edge of the communication hole frontward or rearward in the longitudinal direction of the vehicle.

A position of a rear end of the tail pipe can be substantially aligned with a vertical line which passes through an axle of the rear wheel in a state where the rider sits on the seat.

The front cup can be arranged such that the front cup overlaps with a line which connects a rear end of the seat and a step on which the rider places his foot as viewed in a side view of the vehicle.

Accordingly the front cup can be formed into the tapered tubular shape.

In the motorcycle, legs of a rider vertically extend in the vicinity of rear portions of the main frames. Since the exhaust pipe passes between the left and right main frames, the exhaust pipe is sandwiched between left and right legs of the rider.

By forming the front cup using the tapered tube which is narrowed frontward in the longitudinal direction of the vehicle, it is possible to arrange the front cup close to the legs of the rider.

Due to such a constitution, the front end of the front cup is arranged in the vicinity of the main frames. A distal end of the silencer can be largely shifted frontward in the longitudinal direction of the vehicle compared to a silencer of a prior art. As a result, a length of the silencer can be increased while avoiding the interference between the silencer and the legs of the rider and hence, silencing performance of the silencer can be enhanced. Since the distal end of the silencer can be shifted frontward in the longitudinal direction of the vehicle, the concentration of a mass can be acquired.

The recessed portion which is indented upward is formed on the lower surface of the center sleeve of the silencer, and the brake caliper can be accommodated in the recessed portion.

Accordingly, assuming a case where a lower surface level of the silencer is elevated so as to avoid the interference of the silencer with the brake caliper, a cross-sectional area of the silencer becomes small so that silencing performance is lowered.

According to the present disclosure, instead of elevating the lower surface level of the silencer, the recessed portion which accommodates the brake caliper therein is formed on the center sleeve. With the provision of the recessed portion, the reduction of the cross-sectional area of the silencer becomes small.

That is, according to the present disclosure, it is possible to prevent the interference between the silencer and the brake caliper while allowing the silencer to maintain silencing performance.

Further, assuming a case where the recessed portion is formed on a connection portion between the front cup and the center sleeve, manufacture or assembly of the silencer becomes difficult. However, according to the present disclosure, the recessed portion is formed only on the center sleeve and hence, the manufacture or the assembly of the silencer becomes easy.

Although the front pipe is bent, the front pipe is covered with the front cup and hence, the silencer exhibits the favorable appearance.

Further, the inner pipe exhibits a linear shape parallel to the lower pipe and hence, the center sleeve which surrounds the inner pipe also inevitably extends linearly parallel to the lower pipe whereby the appearance of the silencer can be enhanced as a result.

The tail portion sound absorbing material is filled in the tail cup, the center portion sound absorbing material is filled in the center sleeve, and the front portion sound absorbing material is filled in the front cup.

The tail cup can be connected to the center sleeve in a state where the tail portion sound absorbing material is filled in the tail cup. The front cup can be connected to the center sleeve in a state where the center portion sound absorbing material is filled in the center sleeve, and the front portion sound absorbing material is filled in the front cup. Since the sound absorbing materials can be filled before the connection, a sound absorbing material filling operation becomes easy.

Further, the front portion sound absorbing material is filled in the front cup having a tapered tubular shape and hence, sound absorbing performance can be enhanced.

The front cup can be inserted into the center sleeve, the inserting portion of the front cup is constituted of the straight portion which is brought into contact with the inner peripheral surface of the center sleeve and the tapered portion which has a diameter thereof decreased in a tapered manner from the distal end of the straight portion, and the adhesive agent accumulation portion where the adhesive agent is accumulated is formed on at least one of the straight portion and the tapered portion.

Assuming a case where an adhesive agent is applied to the inserting portion of the front cup and the inserting portion is inserted into the center sleeve, there exists a possibility that the adhesive agent is partially peeled off by an edge of the center sleeve and the peeled-off adhesive agent is accumulated outside the edge of the center sleeve. It is necessary to wipe out the accumulated adhesive agent and hence, the number of manufacture steps is increased, and it is also necessary to apply the adhesive agent by taking an amount of adhesive agent to be peeled off into consideration so that an amount of adhesive agent is increased.

In view of the above, according to the present disclosure, the adhesive agent accumulation portion in which the adhesive agent is accumulated is formed on at least one of the straight portion and the tapered portion. Since the adhesive agent is accumulated in the adhesive agent accumulation portion, it is possible to secure the adhesive agent which contributes to adhesion, and it is also possible to omit a step of wiping out the adhesive agent. Since the adhesive agent which is peeled off by the edge of the center sleeve can be reduced, it is possible to effectively make use of the adhesive agent.

The front cup can be formed by integrally welding the left and right half bodies which are formed by press-molding the stainless steel sheet. The front cup having a tapered tubular shape can be easily manufactured by the press-molding and hence, the front cup having a complicated shape can be manufactured easily at a low cost.

The silencer includes the first fastening portion and the second fastening portion to be fastened to the vehicle body side, and at least the half of the distance between the first fastening portion and the second fastening portion is occupied by the front cup.

Although the first fastening portion and the second fastening portion are provided at a front side and a rear side of the front cup, the front cup exhibits a tapered tubular shape and hence, the front cup has large rigidity. When the front cup is made of the stainless steel, the rigidity of the front cup is further increased. Since the first fastening portion and the second fastening portion are provided at the front side and the rear side of such a front cup, the silencer can be firmly fastened to the vehicle body side.

The center sleeve and the tail cup are partitioned from each other by the partition plate, a plurality of communication holes which allows the inside of the center sleeve and the inside of the tail cup to communicate with each other are formed in the partition plate, and the rib is formed in at least one of the communication holes by folding the edge of the communication hole frontward or rearward in the longitudinal direction of the vehicle.

To increase the rigidity of the partition plate, a technique which increases a wall thickness of the partition plate or a technique which decreases a size of the communication hole is considered. However, such a technique gives rise to a drawback that a weight of the partition plate is increased or a drawback that an expansion chamber in the tail cup cannot be effectively used due to lowering of a circulation amount of an exhaust air into the tail cup.

In this respect, according to the present disclosure, with the formation of the rib, the bending rigidity of the partition plate can be enhanced while securing the light-weight property and an area of the communication holes. With the use of the strong partition plate, it is possible to support even an elongated inner pipe. That is, an expansion volume of the silencer can be easily increased by increasing the rigidity of the partition plate.

The position of the rear end of the tail pipe is substantially aligned with the vertical line which passes through the axle of the rear wheel in a state where the rider sits on the seat. Since the silencer is arranged at the position close to the front side of the vehicle, it is possible to acquire the concentration of the mass.

The front cup is arranged such that the front cup overlaps with the line which connects the rear end of the seat and the step on which the rider places his foot as viewed in a side view of the vehicle.

The legs of the rider are placed in front of the line which connects the rear end of the seat and the step in the longitudinal direction of the vehicle. The front cup which is arranged to overlap with the line which connects the rear end of the seat and the step exhibits a tapered tubular shape which is narrowed frontward in the longitudinal direction of the vehicle. A vehicle width can be narrowed by making use of this tapered tubular shape. The legs of the rider are movable forward and backward in the longitudinal direction of the vehicle at a position where the vehicle width is narrow.

BRIEF DESCRIPTION OF THE DRAWINGS

The advantages of the disclosure will become apparent in the following description taken in conjunction with the drawings, wherein:

FIG. 13 is an explanatory view of the manner of operation of the constitution shown in FIG. 12;

DETAILED DESCRIPTION OF THE INVENTION

Hereinafter, an embodiment of the present disclosure is explained in conjunction with attached drawings. Here, drawings are viewed in the direction of symbols.

An embodiment of the present disclosure is explained in conjunction with drawings.

Figure 1:
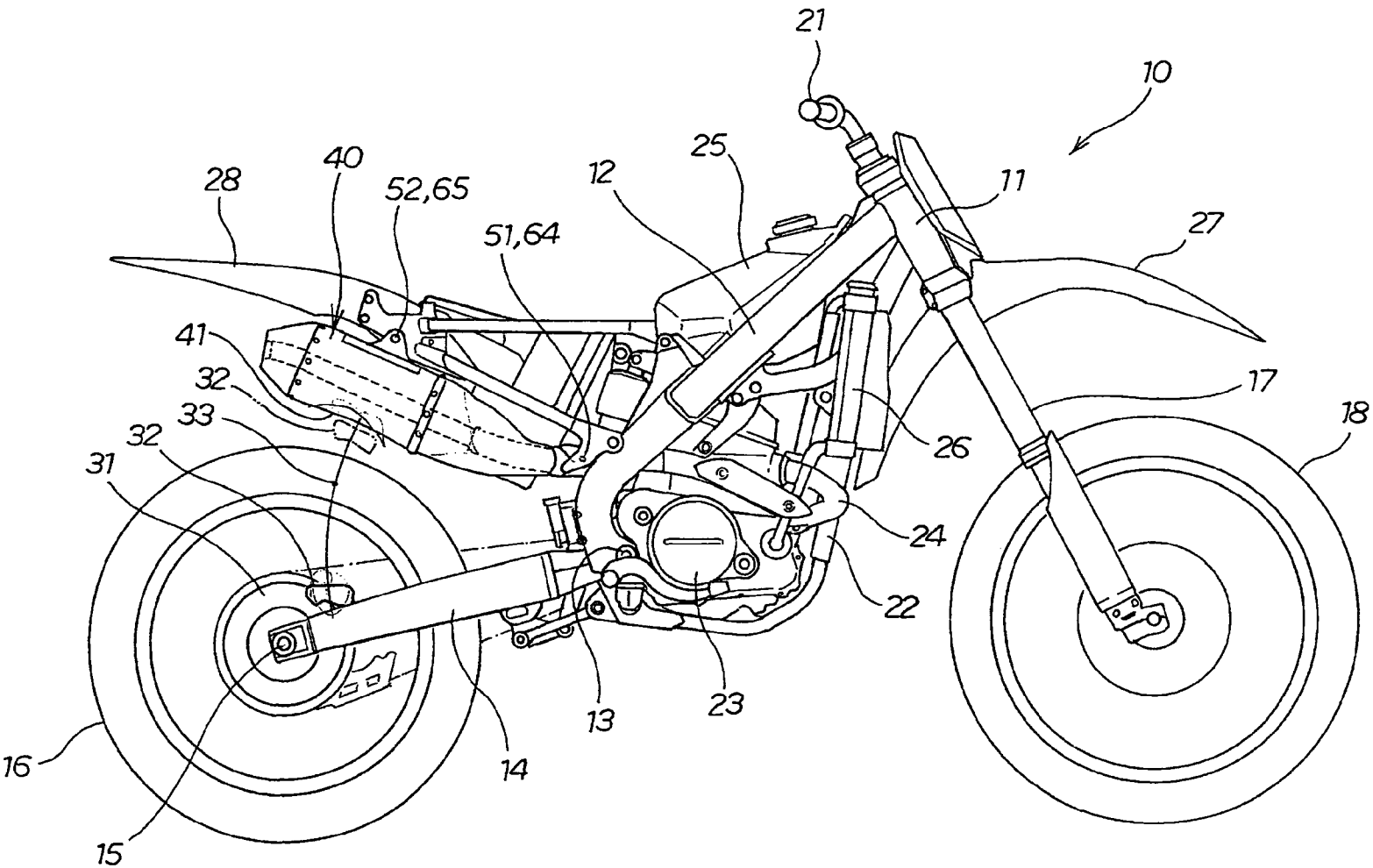
FIG. 1 is a right side view of a motorcycle according to the present disclosure (a seat not shown in the drawing)

As shown in FIG. 1, a motorcycle 10 is a saddle-ride type vehicle which includes, as main components, a pair of left and right main frames 12 which extends obliquely downward and rearward in the longitudinal direction of a vehicle from a head pipe 11, a swing arm 14 which extends rearward in the longitudinal direction of the vehicle from rear portions of the main frames 12 by way of a pivot shaft 13, a rear wheel 16 which is rotatably mounted on a rear portion of the swing arm 14 by way of an axle 15, a front fork 17 which is rotatably (steerably) mounted on the head pipe 11, a front wheel 18 which is rotatably mounted on a lower portion of the front fork 17, a handle 21 which is mounted on an upper end of the front fork 17 and steers the front wheel 18, a down tube 22 which extends downward from an area in the vicinity of the head pipe 11, extends rearward in the longitudinal direction of the vehicle and is connected to lower ends of rear portions of the main frames 12, an internal combustion engine 23 which is arranged between the down tube 22 and the main frames 12 arranged above the down tube 22, an exhaust pipe 24 which extends frontward in the longitudinal direction of the vehicle from the internal combustion engine 23, turns backward, passes along a right side of the internal combustion engine 23 in the vehicle widthwise direction, and extends rearward in the longitudinal direction of the vehicle through between the pair of main frames 12, and a silencer 40 which is connected to a rear end of the exhaust pipe 24.

The internal combustion engine 23 is a gasoline engine, and is particularly favorably a water-cooled 4-stroke gasoline engine. A fuel tank 25 for the internal combustion engine 23 is supported on the main frames 12 at a position behind the head pipe 11 in the longitudinal direction of the vehicle, and a radiator 26 for the internal combustion engine 23 is arranged along the down tube 22.

In the saddle-ride type vehicle, a front fender 27 is arranged at a position sufficiently higher than the front wheel 18, and a rear fender 28 is arranged at a position sufficiently higher than the rear wheel 16.

A brake disc 31 is attached to the rear wheel 16, and the brake disc 31 is brought into a braking state by a brake caliper 32 which is mounted on an upper surface of the swing arm 14.

The silencer 40 is arranged above the brake caliper 32 and hence, a moving trajectory 33 of the brake caliper 32 which is drawn about the pivot shaft 13 intersects with the silencer 40. Accordingly, it is necessary to take a measure which prevents the brake caliper 32 from hitting the silencer 40.

In view of the above, in this embodiment, a lower surface of the silencer 40 is indented upward so as to form a recessed portion 41 which can accommodate the brake caliper 32 therein.

Assuming a case where a lower surface level of the silencer 40 is elevated so as to prevent the silencer 40 from interfering with the brake caliper 32, a cross-sectional area of the silencer 40 becomes small so that the silencing performance is lowered.

Also assuming a case where a protector is mounted on the silencer 40 so as to prevent the brake caliper 32 from hitting the silencer 40, a cost for purchasing the protector and a cost for mounting the protector are incurred.

According to the present disclosure, instead of elevating the lower surface level of the silencer 40, the recessed portion 41 which accommodates the brake caliper 32 therein is formed on the silencer 40. By forming the recessed portion 41, the reduction of the cross-sectional area of the silencer 40 becomes small. That is, it is possible to prevent the silencer 40 from interfering with the brake caliper 32 while maintaining the silencing property of the silencer 40.

Also the protector is unnecessary and hence, the increase of the cost can be suppressed.

Next, a member which supports the silencer 40 is explained.

Figure 2:
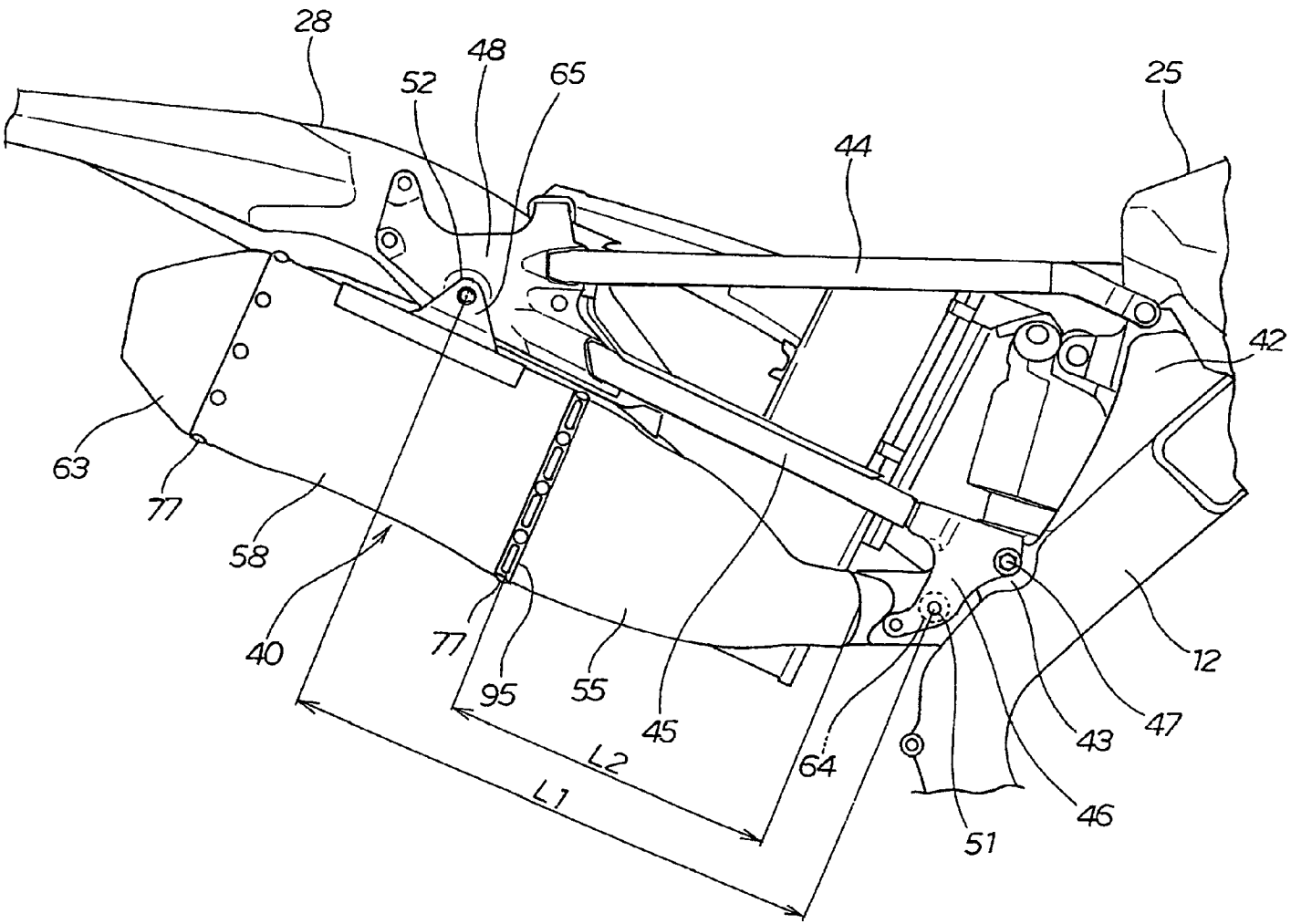
FIG. 2 is an enlarged view of an essential part of the motorcycle shown in FIG. 1.

As shown in FIG. 2, a trapezoidal upper projecting portion 42 which projects upward is integrally formed with the main frame 12, and a lower projecting portion 43 which projects rearward in the longitudinal direction of the vehicle is integrally formed with the main frame 12 at a position below the upper projecting portion 42.

A seat pipe 44 extends rearward in the substantially horizontal direction of the vehicle from the upper projecting portion 42. Further, a lower pipe 45 extends as a member separate from the seat pipe 44, an L-shaped front attachment 46 is fixed to a front end of the lower pipe 45, and the front attachment 46 is fastened to the lower projecting portion 43 using a bolt 47. Further, a triangular rear attachment 48 is fixed to a rear end of the lower pipe 45, and a rear end of the seat pipe 44 is fixed to the rear attachment 48. That is, the seat pipe 44 and the lower pipe 45 constitute a V-shaped member.

The lower pipe 45 plays a role of a member which prevents the deflection of the seat pipe 44.

Further, a first vehicle-body-side fastening portion 51 is formed on the front attachment 46, and a second vehicle-body-side fastening portion 52 is formed on the rear attachment 48. That is, the first vehicle-body-side fastening portion 51 is formed on the front end of the lower pipe 45, and the second vehicle-body-side fastening portion 52 is formed on the rear end of the lower pipe 45.

The first vehicle-body-side fastening portion 51 and the second vehicle-body-side fastening portion 52 are members for supporting the silencer 40.

Next, the structure of the silencer 40 is explained. Here, FIG. 3 shows the constitution of the silencer 40 as viewed from a center side of the vehicle body.

Figure 3:
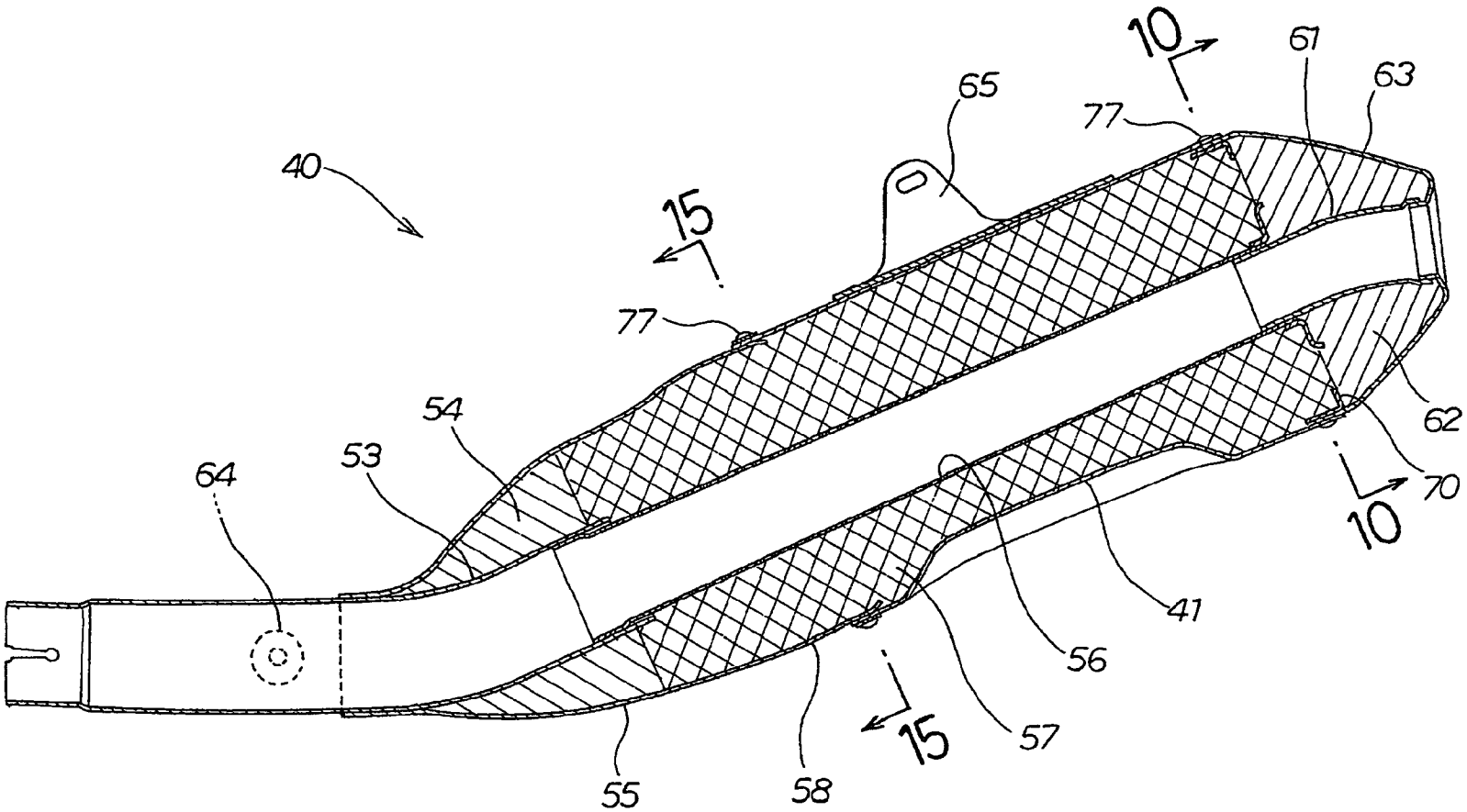
FIG. 3 is a cross-sectional view of a silencer.

As shown in FIG. 3, the silencer 40 is constituted of a front cup 55 having a tapered tubular shape which surrounds a front pipe 53, is filled with a front portion sound absorbing material 54 and increases the cross-sectional area thereof rearward in the longitudinal direction of the vehicle, a center sleeve 58 which surrounds an inner pipe 56 having a porous tubular shape and is filled with a center portion sound absorbing material 57, and a tail cup 63 which surrounds a tail pipe 61 and is filled with a tail portion sound absorbing material 62.

That is, the silencer 40 can be obtained by assembling three elements consisting of the front cup 55, the center sleeve 58, and the tail cup 63.

Here, a first fastening portion 64 into which a bolt can be threaded is mounted on a portion of the front pipe 53 which projects from the front cup 55 before the three elements are assembled to each other.

Also a second fastening portion 65 which allows a bolt to pass therethrough is mounted on an upper surface of the center sleeve 58 in advance (before the three elements are assembled to each other).

As can be clearly understood from the drawings, the tapered-tubular-shaped front cup 55 has a sufficient length comparable to a length of the center sleeve 58. As a result, it is possible to secure a large expansion chamber also in the inside of the front cup 55.

Figure 4:
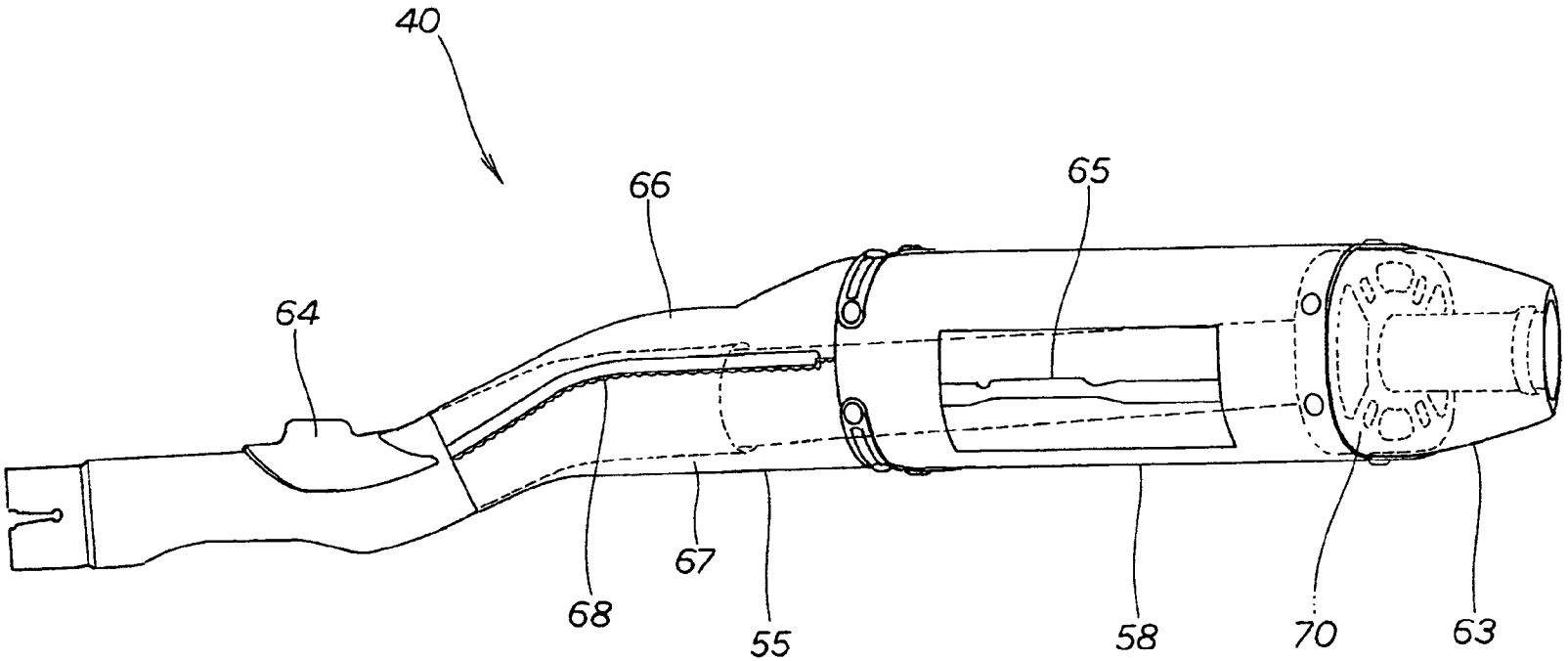
FIG. 4 is a plan view of the silencer.

Further, the front cup 55 is, as shown in FIG. 4, formed by integrally joining a pair of left and right half bodies 66, 67 which is formed by press-molding to each other with a butt welding bead 68.

In this embodiment, the front cup 55 is made of stainless steel. Stainless steel is hard compared to soft steel (ordinary carbon steel) so that plastic working of stainless steel is difficult. In view of such a circumstance, the half bodies 66, 67 are formed by press-molding a flat plate. With the use of press-molding, a complicated shape can be easily formed. Accordingly, it is safe to say that a method in which the half bodies 66, 67 are formed by press-molding and the half bodies 66, 67 are formed into an integral body by welding is a method which is preferably applicable to the manufacture of the front cup 55 having a complicated shape such as a tapered tubular shape.

Returning to FIG. 2, the first fastening portion 64 which fastens the silencer 40 to the vehicle body side is formed on a portion of the front pipe outside the front cup 55, and the second fastening portion 65 which fastens the silencer 40 to the vehicle body side is formed on the center sleeve 58. Further, assuming a distance between the first fastening portion 64 and the second fastening portion 65 as L1 and assuming a length of the front cup 55 as L2, L2 is set larger than a half of L1.

Although the first fastening portion 64 and the second fastening portion 65 are formed on the front and the rear of the front cup 55 respectively, the front cup 55 exhibits a tapered tubular shape and hence, the front cup 55 has large rigidity. When the front cup 55 is made of stainless steel, the rigidity of the front cup 55 is further increased. By forming the first fastening portion 64 and the second fastening portion 65 on the front and the rear of the front cup 55 in this manner, the silencer 40 can be firmly fastened to the vehicle body side.

One preferred example of a method of assembling the silencer 40 is explained hereinafter.

Figure 5:
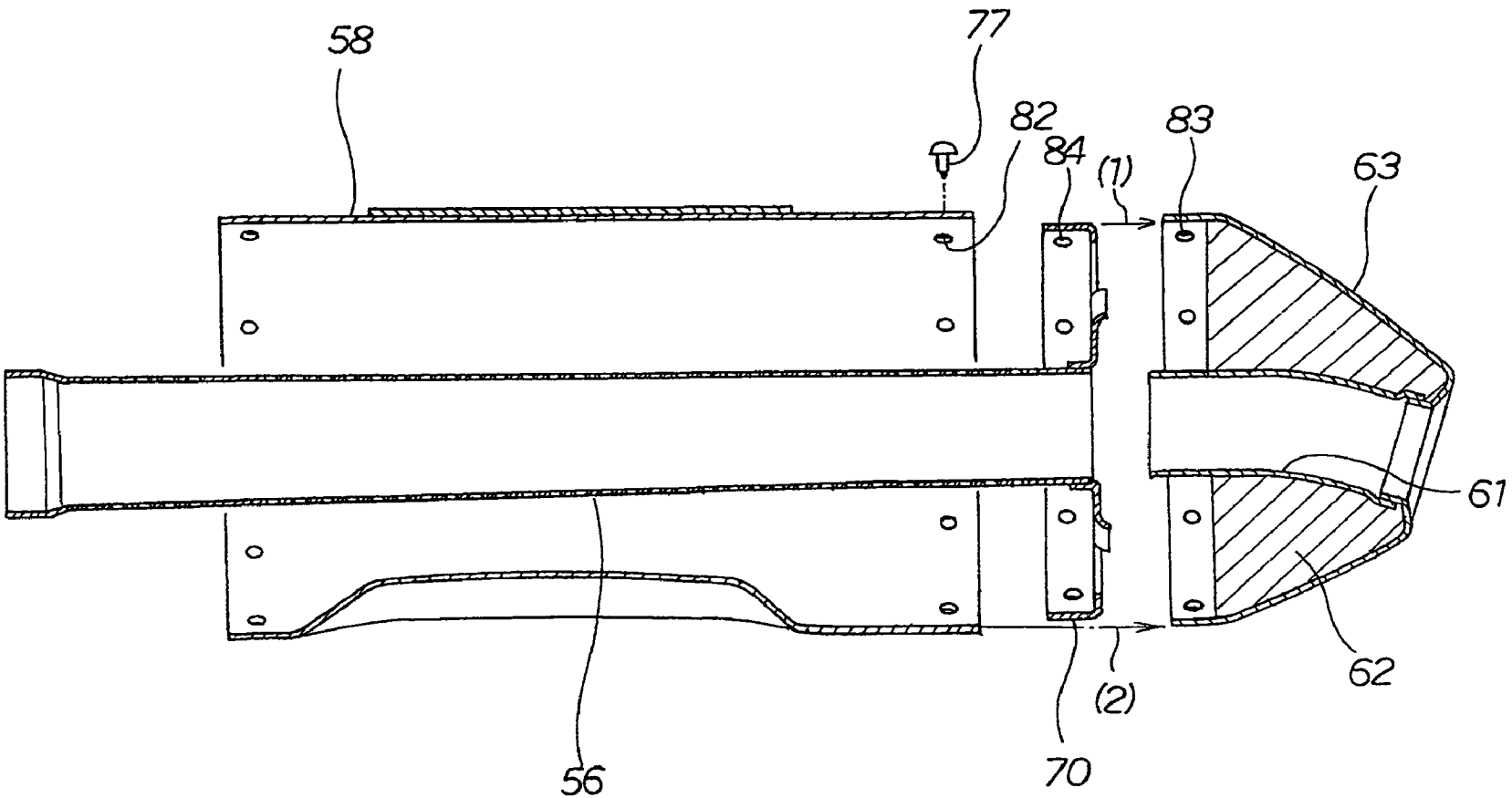
FIG. 5 is an exploded view of a tail cup and a center sleeve.

As shown in FIG. 5, the tail pipe 61 is mounted on the tail cup 63. Then, the tail portion sound absorbing material 62 is filled in the tail cup 63 at predetermined packing density such that the tail portion sound absorbing material 62 surrounds the tail pipe 61.

On the other hand, a rear end of the inner pipe 56 is mounted on a partition plate 70.

Figure 6:
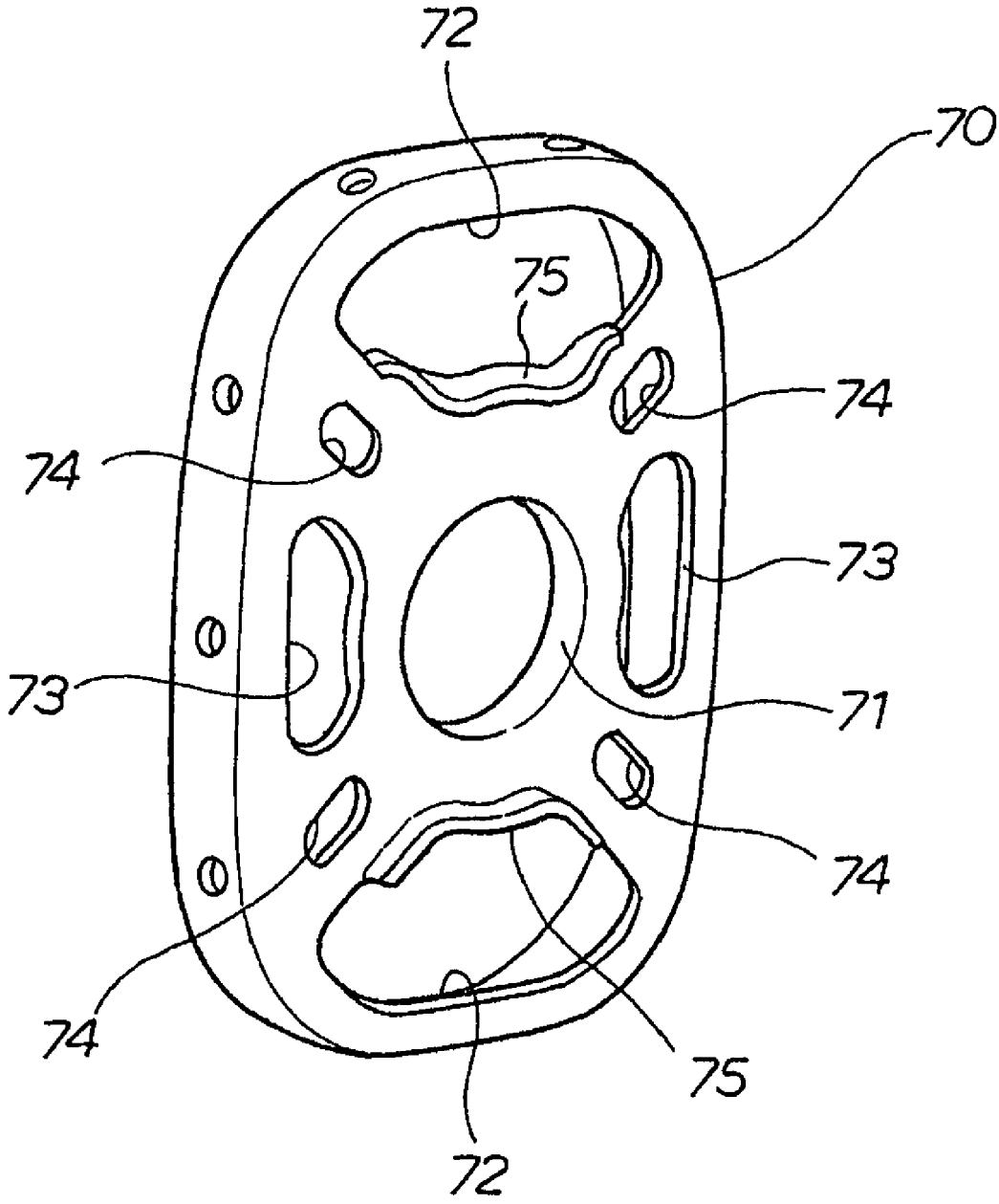
FIG. 6 is a perspective view of a partition plate.

As shown in FIG. 6, the partition plate 70 is formed by press-molding a metal plate. A support hole 71 which supports the inner pipe 56 is formed in a substantially center portion of the partition plate 70, and a plurality of communication holes 72, 73, 74 having large, middle and small diameters respectively (8 pieces in total in this embodiment) are formed in the partition plate 70 such that the communication holes 72, 73, 74 surround the support hole 71. Ribs 75, 75 are formed in at least one of the communication holes 72, 73, 74 (two communication holes 72 in this embodiment) by folding edges of the communication holes backward in the longitudinal direction of the vehicle. Here, there is no problem in forming the ribs 75, 75 by folding the edges of the communication holes frontward in the longitudinal direction of the vehicle.

Figure 7:
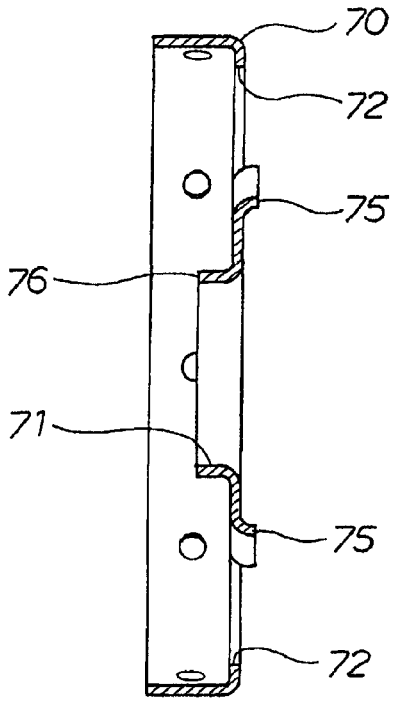
FIG. 7 is a cross-sectional view of the partition plate.

To be more specific, as shown in FIG. 7, an edge of the support hole 71 is folded frontward in the longitudinal direction of the vehicle thus forming a nose portion 76, and the edges of the communication holes 72, 72 are folded backward in the longitudinal direction of the vehicle thus forming the ribs 75, 75.

The nose portion 76 and the ribs 75, 75 play a role of enhancing bending rigidity of the partition plate 70.

Returning to FIG. 5, as indicated by an arrow (1), the partition plate 70 is inserted into a front portion of the tail cup 63.

Next, as indicated by an arrow (2), the tail cup 63 is covered with a rear portion of the center sleeve 58. Further, the center sleeve 58, the tail cup 63 and the partition plate 70 are fastened together using rivets 77.

As the rivet 77, a part which is called "a blind rivet" can be preferably used. Next, the configuration and the manner of operation of the blind rivet are explained.

Figure 8:
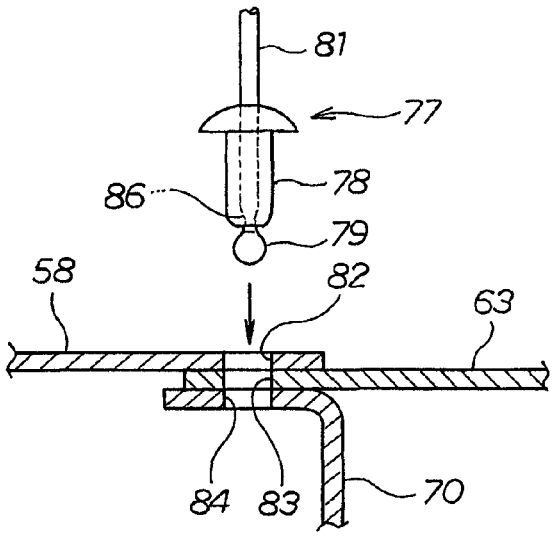
FIG. 8 is a profile view of a rivet.

As shown in FIG. 8, the rivet 77 is constituted of a hollow rivet 78 and a rod 81 which is inserted into the hollow rivet 78 and forms a spherical portion 79 on one end thereof. Here, rivet holes 82 are formed in the center sleeve 58 in advance, rivet holes 83 are formed in the tail cup 63 in advance, and rivet holes 84 are formed in the partition plate 70 in advance. The hollow rivet 78 is inserted into the rivet holes 82 to 84 together with the rod 81.

Figure 9A:
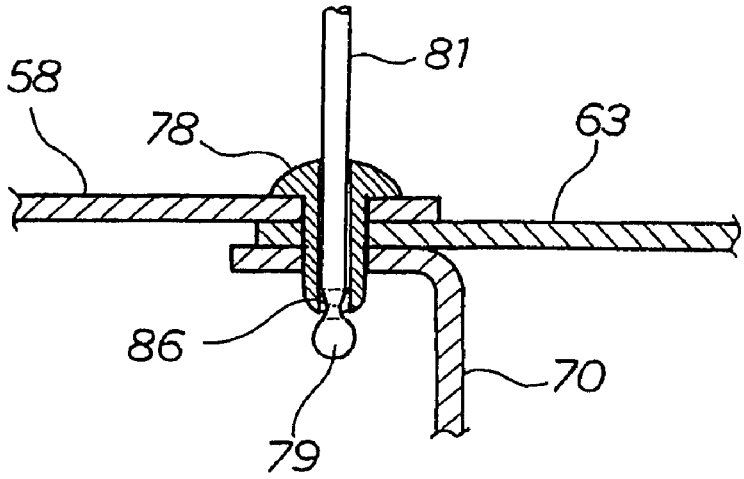
FIG. 9 is a view for explaining a method of mounting the rivet.
Figure 9B:
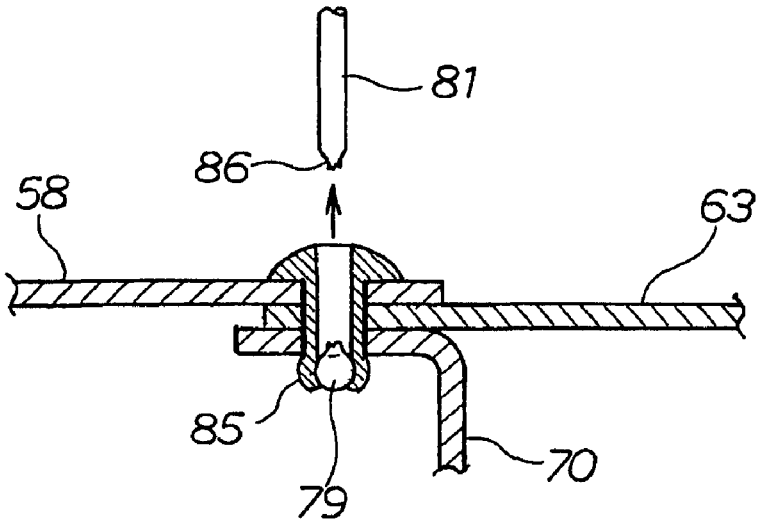

As shown in FIG. 9(*a*), when the rod 81 is pulled in the removing direction, the spherical portion 79 expands a distal end of the hollow rivet 78 thus forming a bulb portion 85 on the hollow rivet 78. When the rod 81 is further pulled, the spherical portion 79 hits the partition plate 70 so that the movement of the rod 81 is restricted. A brittle portion 86 having a small diameter is formed on a root of the spherical portion 79.

When the rod 81 is further pulled, as shown in FIG. 9(*b*), the rod 81 is broken at the brittle portion 86. With respect to the spherical portion 79, even when an axial force is applied to the rivet 77 after such breaking, the remaining spherical portion 79 holds a shape of the bulb portion 85 thus maintaining a fastening function.

Figure 10:
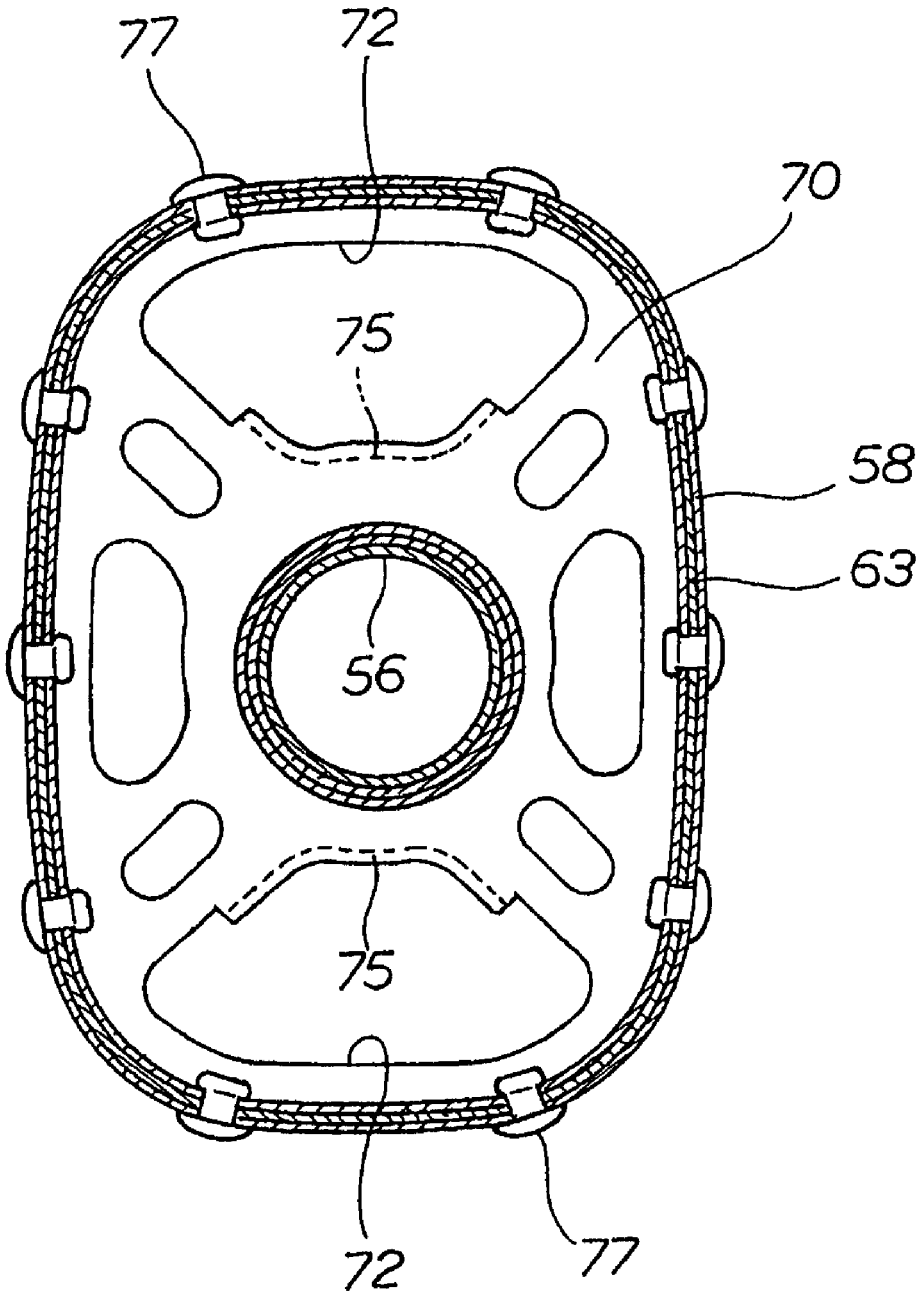
FIG. 10 is a cross-sectional view taken along a line 10-10 in FIG. 3.

As a result, as shown in FIG. 10, the center sleeve 58, the tail cup 63 and the partition plate 70 are integrally fastened together by the plurality of (10 pieces in this embodiment) rivets 77.

Figure 11:
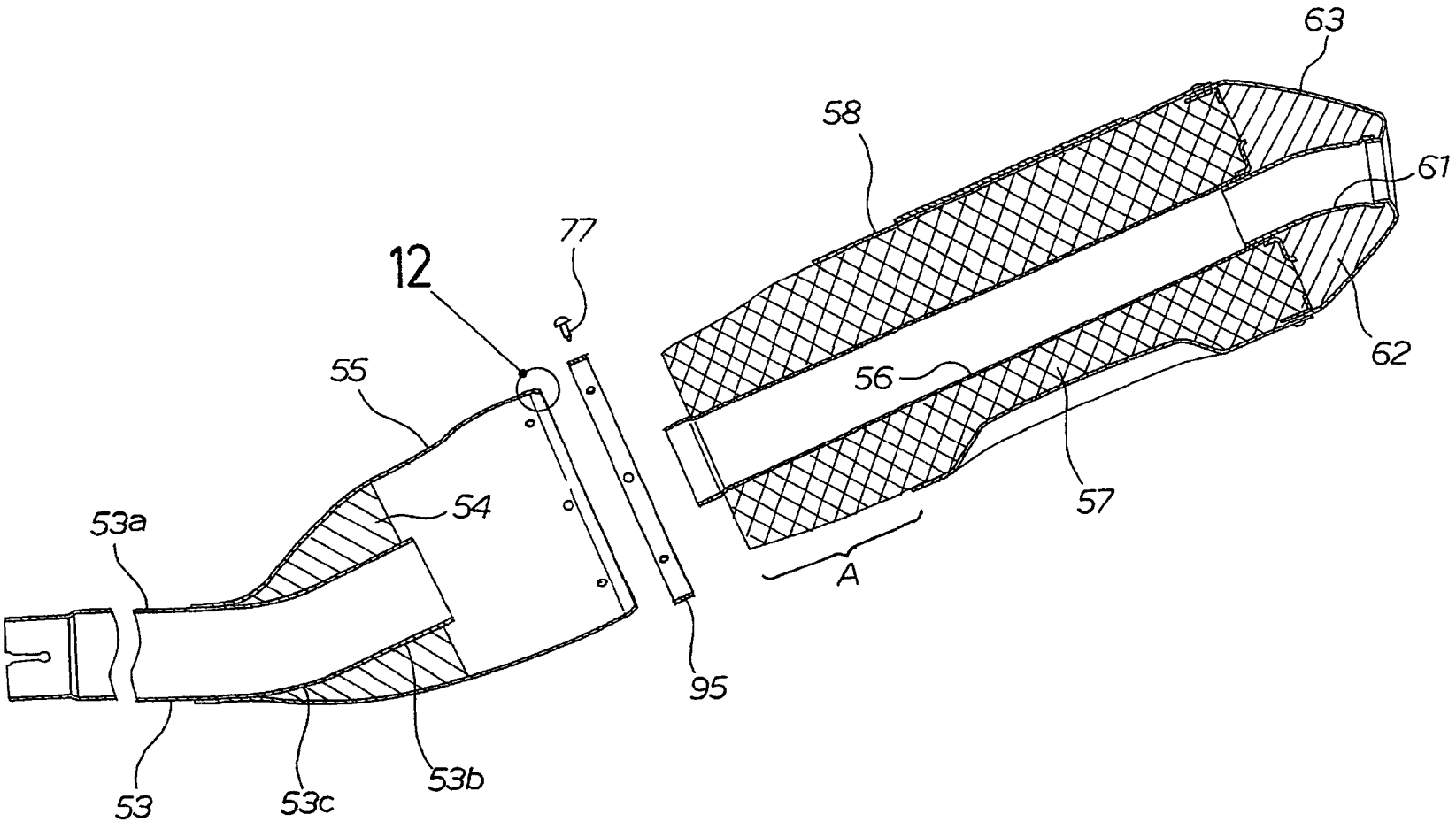
FIG. 11 is a developed view of the center sleeve and a front cup.

Next, as shown in FIG. 11, the center portion sound absorbing material 57 is filled in the center sleeve 58 such that the center portion sound absorbing material 57 surrounds the inner pipe 56. Here, the inner pipe 56 is longer than the center sleeve 58 and projects from a front end of the center sleeve 58. The center portion sound absorbing material 57 is wound around the inner pipe 56 by an amount corresponding to a length of the inner pipe 56. As a result, a portion (a range A) of the center portion sound absorbing material 57 is exposed (projects) from the center sleeve 58.

On the other hand, the front portion sound absorbing material 54 is filled in the front cup 55 having a tapered tubular shape on which the front pipe 53 is mounted. A front portion 53*a* of the front pipe 53 projects from the front cup 55. Although a rear portion 53*b* of the front pipe 53 is accommodated in the front cup 55, the front portion 53*a* having a linear shape and the rear portion 53*b* having a linear shape are connected to each other by a bent pipe portion 53*c* which is formed by bending.

The bent pipe portion 53*c* is accommodated in the front cup 55 and hence, there is no possibility that the bent pipe portion 53*c* is viewed from the outside. The front pipe 53 is formed by bending one pipe material.

A rear end of the front pipe 53 extends to a middle portion (a substantially intermediate portion in the longitudinal direction) of the front cup 55. Accordingly, the front portion sound absorbing material 54 is filled in a front half portion of the front cup 55.

A rear end of the front cup 55 is inserted into the center sleeve 58, and an insertion portion of the front cup 55 is improved in shape.

Figure 12:
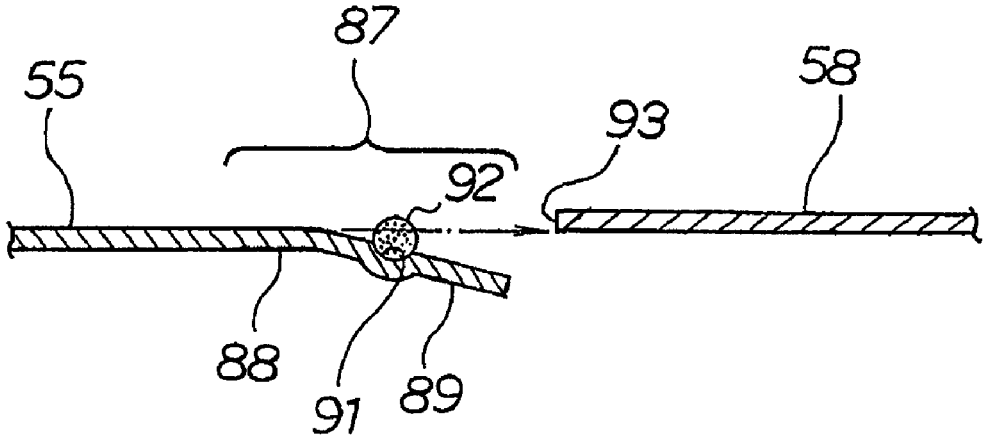
FIG. 12 is an enlarged view of a portion 12 shown in FIG. 11.

As shown in FIG. 12, an insertion portion 87 of the front cup 55 is constituted of a straight portion 88 which is brought into contact with an inner peripheral surface of the center sleeve 58, a tapered portion 89 which has a diameter thereof decreased in a tapered manner from a distal end of the straight portion 88, and an circular-annular-groove-shaped adhesive agent accumulation portion 91 which is formed on the tapered portion 89. The manner of operation of the adhesive agent accumulation portion 91 is explained in conjunction with FIG. 13.

To facilitate the explanation, a comparison example which is not provided with the adhesive agent accumulation portion 91 is firstly explained in conjunction with FIG. 13(*a*) and FIG. 13(*b*).

As shown in FIG. 13(*a*), assume a case where an adhesive agent 92 is applied to a simple tapered portion 89 and the insertion portion 87 is inserted into the center sleeve 58. In this case, there exists a possibility that the adhesive agent 92 is peeled off by an edge 93 of the center sleeve 58 so that, as shown in FIG. 13(*b*), the peeled-off adhesive agent 92 is accumulated outside the edge 93 of the center sleeve 58. It is necessary to wipe out an accumulated adhesive agent 92 and hence, a step of wiping out the adhesive agent is added.

In view of the above, according to the present disclosure, as shown in FIG. 13(*c*), the adhesive agent accumulation portion 91 in which the adhesive agent 92 is accumulated is formed on the tapered portion 89. Since the adhesive agent 92 is accumulated in the adhesive agent accumulation portion 91, it is possible to secure the adhesive agent 92 which contributes to adhesion. It is also possible to reduce an amount of adhesive agent which is peeled off by the edge 93 of the center sleeve 58 thus realizing the effective use of the adhesive agent.

Figure 14A:
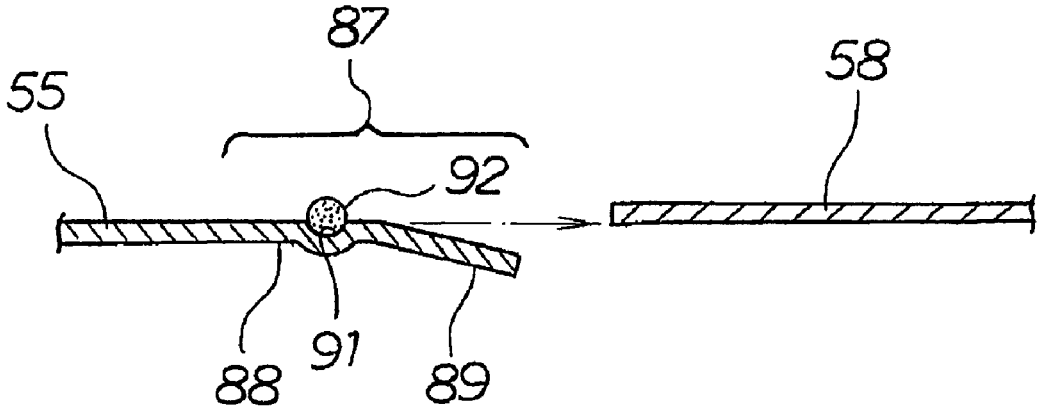
FIG. 14 is a view for explaining a modification of the constitution shown in FIG. 12.
Figure 14B:
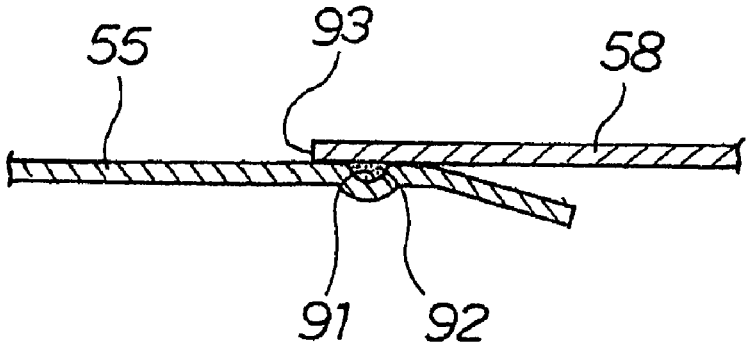

FIG. 14 is a view showing a modification of the constitution shown in FIG. 12. As shown in FIG. 14(*a*), the adhesive agent accumulation portion 91 in which the adhesive agent 92 is accumulated may be formed on the straight portion 88. As shown in FIG. 14(*b*), since the adhesive agent 92 is accumulated in the adhesive agent accumulation portion 91, it is possible to secure the adhesive agent 92 which contributes to adhesion. It is also possible to reduce an amount of an adhesive agent which is peeled off by the edge 93 of the center sleeve 58 thus realizing the effective use of the adhesive agent.

The adhesive agent accumulation portion 91 can be formed on one or both of the tapered portion 89 and the straight portion 88.

Returning to FIG. 11, the front cup 55 is inserted into a front portion of the center sleeve 58. Next, a belt 95 is wound around the front portion of the center sleeve 58, and the rivets 77 are driven such that the rivets 77 penetrate the belt 95, the center sleeve 58 and the front cup 55. The structure and the manner of operation of the rivets 77 have been already explained in conjunction with FIG. 8 and FIG. 9 and hence, their explanation is omitted.

Figure 15:
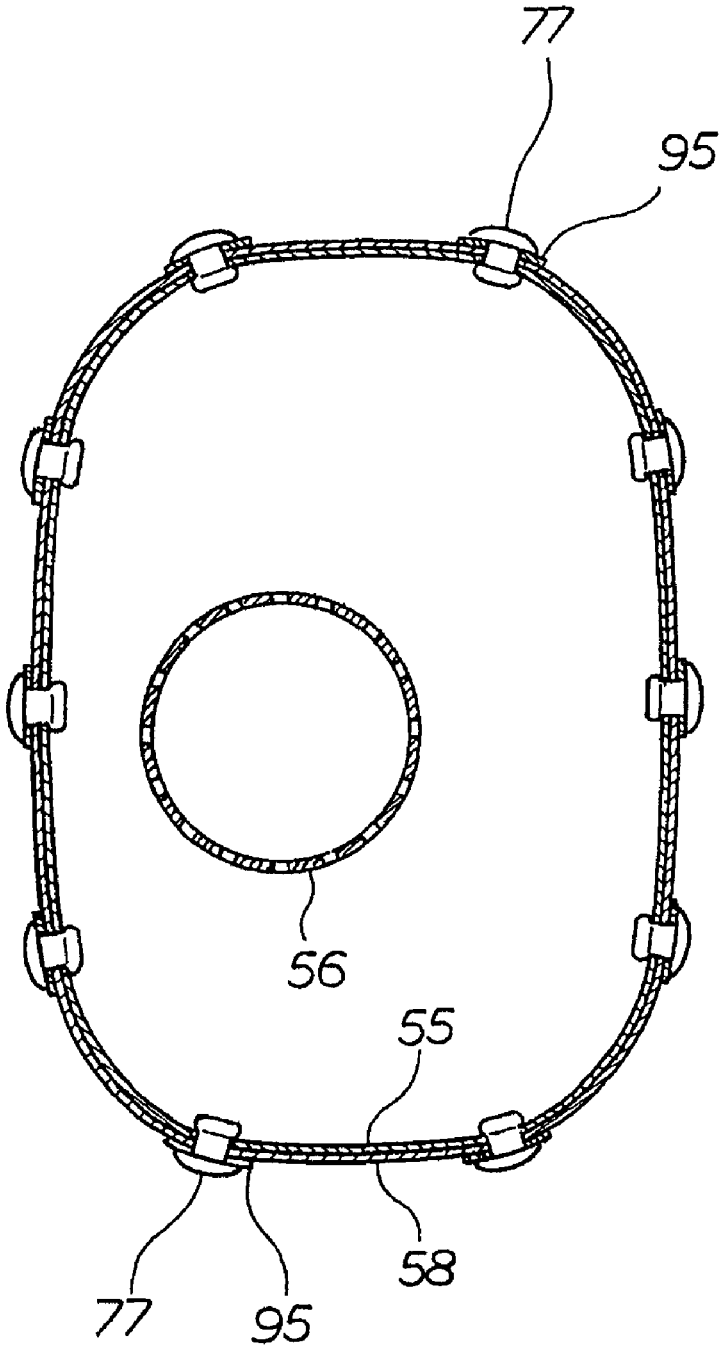
FIG. 15 is a cross-sectional view taken along a line 15-15 in FIG. 3.

As shown in FIG. 15, the plurality (10 pieces in this embodiment) of rivets 77 are arranged, and the rivets 77 fasten the center sleeve 58 and the front cup 55 together.

The explanation is made with respect to a state where the silencer which has been explained heretofore is mounted on the vehicle body.

Figure 16:
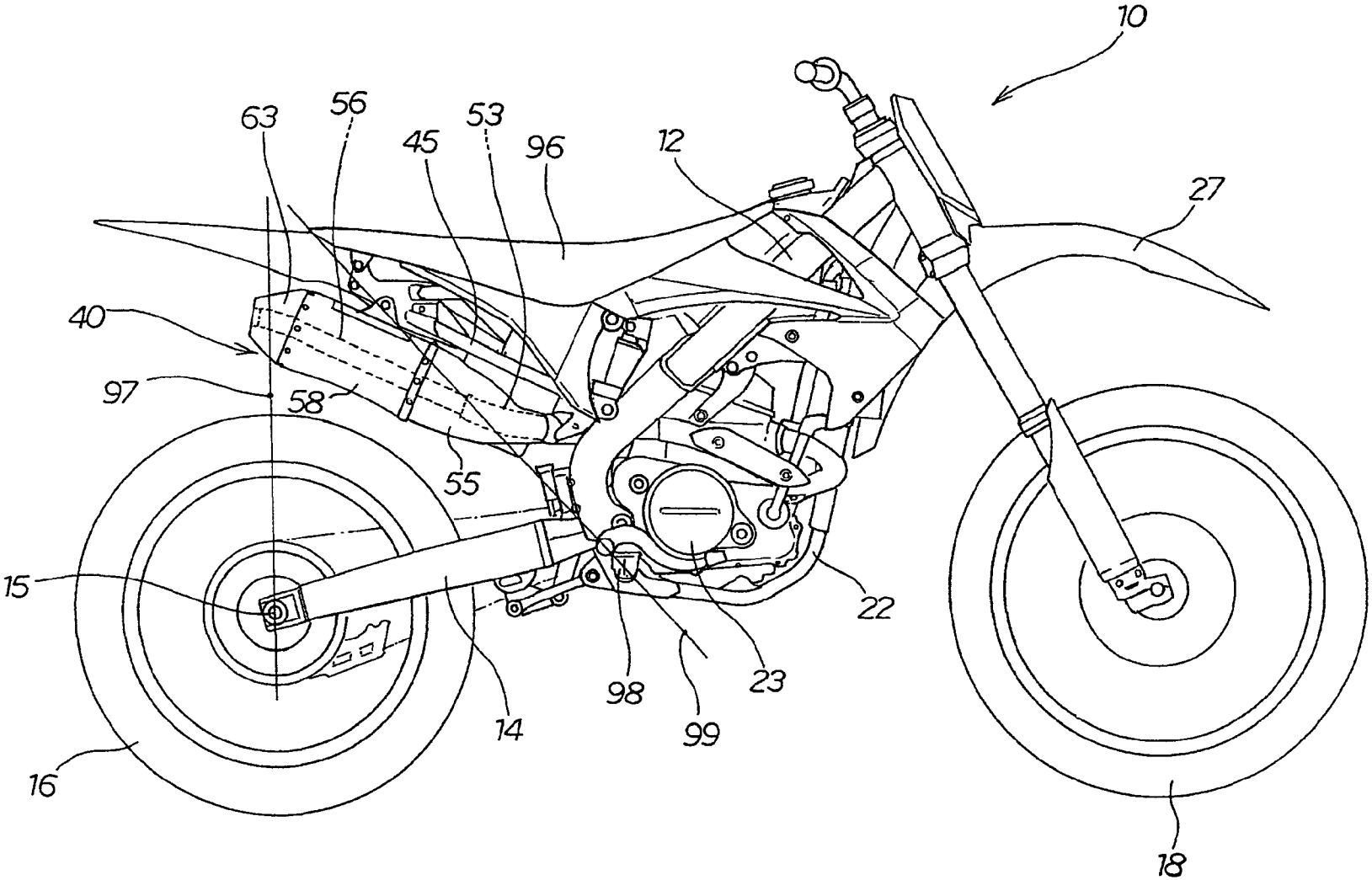
FIG. 16 is a right side view of the motorcycle according to the present disclosure (the seat shown in the drawing)

As shown in FIG. 16, a seat 96 on which a rider sits is mounted on the vehicle body in a state where the seat 96 extends in the longitudinal direction of the vehicle from an area above the main frames 12 to an area above the lower pipe 45.

Further, a position of a rear end of the tail cup 63 is substantially aligned with a vertical line 97 which passes through the axle 15 of the rear wheel 16 in a state where the rider sits on the seat 96. Since the silencer 40 is arranged at a position close to a front side of the vehicle, the concentration of the mass is realized.

Further, the front cup 55 is arranged such that the front cup 55 overlaps with a line 99 which connects a rear end of the seat 96 and a step 98 on which the rider places his foot.

The legs of the rider are placed in front of the line 99 which connects the rear end of the seat 96 and the step 98 in the longitudinal direction of the vehicle. The front cup 55 which is arranged in an overlapping manner with the line 99 connecting the rear end of the seat 96 and the step 98 exhibits a tapered tubular shape which is narrowed frontward in the longitudinal direction of the vehicle.

Figure 17:
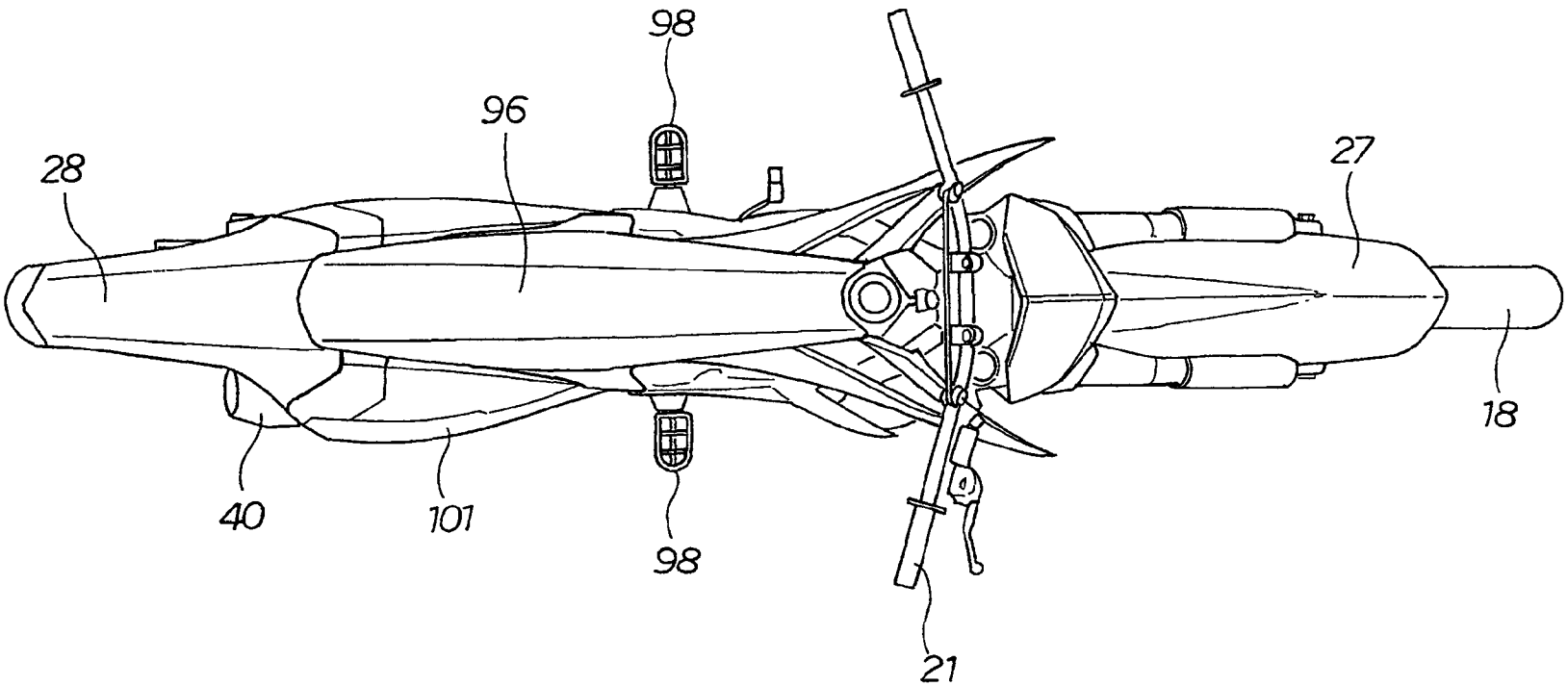
FIG. 17 is a plan view of the motorcycle according to the present disclosure.

As a result, as shown in FIG. 17, a vehicle width can be narrowed by making use of the tapered tubular shape. The legs of the rider are movable forward and backward in the longitudinal direction of the vehicle at a position where the vehicle width is narrowed.

In FIG. 17, the silencer 40 is covered with a cover 101 except for a rear end portion thereof.

Further, although the front pipe 53 is bent as shown in FIG. 16, the bent portion of the front pipe 53 is covered with the front cup 55 and hence, the silencer 40 exhibits the favorable appearance.

Further, the inner pipe 56 exhibits a linear shape parallel to the lower pipe 45 and hence, the center sleeve 58 which surrounds the inner pipe 56 also inevitably extends linearly parallel to the lower pipe 45 whereby the appearance of the silencer 40 can be enhanced as a result.

Further, the front end of the front cup 55 is arranged in the vicinity of the main frames 12. Accordingly, the distal end of the silencer 40 can be largely shifted frontward in the longitudinal direction of the vehicle compared to a silencer of the prior art. As a result, a length of the silencer 40 can be increased while avoiding the interference between the silencer 40 and the legs of the rider and hence, the silencing performance of the silencer 40 can be enhanced. Since the distal end of the silencer 40 can be shifted frontward in the longitudinal direction of the vehicle, the concentration of a mass can be realized.

Although the present disclosure is applied to an off-road bike, there is no problem in applying the present disclosure to motorcycles having other configurations such as a sport bike.

The present disclosure is preferably applicable to an off-road motorcycle which is particularly required to possess the concentration of a mass.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. A motorcycle in which a pair of left and right main frames extends obliquely downward and rearward in a longitudinal direction of the motorcycle from a head pipe, a swing arm is swingably connected to rear portions of the main frames, a rear wheel is rotatably mounted on the swing arm, an internal combustion engine is arranged below the main frames, an exhaust pipe extends frontward in the longitudinal direction of the motorcycle from the internal combustion engine, turns backward, and extends rearward in the longitudinal direction of the motorcycle through the left and right main frames, and a silencer is connected to a rear end of the exhaust pipe, wherein the silencer comprises:

a front cup, as viewed in a side view of the motorcycle, has a front end thereof arranged in the vicinity of the main frames, has a tapered tubular shape where a cross-sectional area is increased rearward in the longitudinal direction of the motorcycle, has a rear end thereof arranged in front of a position of an axle when the swing arm is fully bent in the longitudinal direction of the motorcycle, and accommodates a front pipe connected to the exhaust pipe therein;

a center sleeve which extends rearward in the longitudinal direction of the motorcycle from the rear end of the front cup and accommodates an inner pipe having a porous tubular shape connected to the front pipe therein; and a tail cup which extends rearward in the longitudinal direction of the motorcycle from a rear end of the center sleeve and accommodates a tail pipe connected to the inner pipe therein.

2. The motorcycle according to claim 1, wherein a brake caliper which applies braking to the rear wheel is mounted on an upper surface of the swing arm, a recessed portion which is indented upward is formed on a lower surface of the center sleeve above a moving trajectory of the brake caliper due to swinging of the swing arm, and wherein the brake caliper is accommodated in the recessed portion.

3. The motorcycle according to claim 2, wherein a seat pipe which supports a seat on which a rider sits extends rearward in the longitudinal direction of the motorcycle from the main frames, and a lower pipe extends frontward and downward in the longitudinal direction of the motorcycle to the main frames from a rear end of the seat pipe for preventing the deflection of the seat pipe, the front pipe is bent at a position between a front portion and a rear portion such that the rear portion of the front pipe becomes parallel to the lower pipe, and the rear portion extends to a middle portion of the front cup, and wherein the inner pipe has a linear shape parallel to the lower pipe, and extends to a middle portion of the front pipe.

4. The motorcycle according to claim 3, wherein a tail portion sound absorbing material is filled in the tail cup such that the tail portion sound absorbing material surrounds the tail pipe, a center portion sound absorbing material is filled in the center sleeve connected to the tail cup such that the center portion sound absorbing material surrounds the inner pipe, a front portion sound absorbing material is filled in the front cup such that the front portion sound absorbing material surrounds the front pipe, and the front cup is connected to the center sleeve in such a state.

5. The motorcycle according to claim 4, wherein the front cup is inserted into the center sleeve, an inserting portion of the front cup is constituted of a straight portion which is brought into contact with an inner peripheral surface of the center sleeve and a tapered portion which has a diameter thereof decreased in a tapered manner from a distal end of the straight portion, and an adhesive agent accumulation portion, where an adhesive agent is accumulated, is formed on one of the straight portions and the tapered portion.

6. The motorcycle according to claim 5, wherein the front cup is formed by integrally welding left and right half bodies which are formed by press-molding a stainless steel sheet.

7. The motorcycle according to claim 6, wherein a first fastening portion which fastens the silencer to a motorcycle body side is formed on the front pipe at a position outside the front cup, a second fastening portion which fastens the silencer to the motorcycle body side is formed on the center sleeve, and at least a half of a distance between the first fastening portion and the second fastening portion is occupied by the front cup, and a first motorcycle-body-side fastening portion to which the first fastening portion is fastened is formed on a front end portion of the lower pipe, and a second motorcycle-body-side fastening portion to which the second fastening portion is fastened is formed on a rear end portion of the lower pipe.

8. The motorcycle according to claim 7, wherein the center sleeve and the tail cup are partitioned by a partition plate, and a support hole, which supports a rear end of the inner pipe, is formed in the partition plate, a plurality of communication holes which allow the inside of the center sleeve and the inside of the tail cup to communicate with each other are formed in the partition plate such that the communication holes surround the support hole, and a rib is formed in at least one of the communication holes by folding an edge of the communication hole frontward or rearward in the longitudinal direction of the motorcycle.

9. The motorcycle according to claim 8, wherein a position of a rear end of the tail pipe is substantially aligned with a vertical line which passes through an axle of the rear wheel in a state where the rider sits on the seat.

10. The motorcycle according to claim 9, wherein the front cup is arranged such that the front cup overlaps with a line which connects a rear end of the seat and a step on which the rider places his foot as viewed in a side view of the motorcycle.

* * * * *